United States Patent [19]

Richmond

[11] 4,033,263

[45] July 5, 1977

[54] WIDE RANGE POWER CONTROL FOR ELECTRIC DISCHARGE LAMP AND PRESS USING THE SAME

[75] Inventor: Abraham W. Richmond, West Melbourne, Fla.

[73] Assignee: Harris Corporation, Cleveland, Ohio

[22] Filed: Oct. 20, 1975

[21] Appl. No.: 623,680

Related U.S. Application Data

[62] Division of Ser. No. 532,172, Dec. 12, 1974.

[52] U.S. Cl. ..... 101/416 A; 34/52; 101/1

[51] Int. Cl.² ..... B41F 23/00

[58] Field of Search ... 101/416 A, 1, 181, DIG. 13, 101/364–366; 197/1; 34/52, 48, 49

[56] References Cited

UNITED STATES PATENTS

| | | | |
|---|---|---|---|
| 2,167,472 | 7/1939 | Bedford | 313/22 X |
| 3,078,587 | 2/1963 | Huck | 101/416 A |
| 3,234,871 | 2/1966 | Ostwald | 101/142 |
| 3,526,191 | 9/1970 | Silverberg | 101/DIG. 13 |
| 3,531,684 | 9/1970 | Nuckolls | 315/156 X |
| 3,539,316 | 11/1970 | Trethewey | 34/52 X |
| 3,694,692 | 9/1972 | Pressman | 315/156 X |
| 3,700,962 | 10/1972 | Munson | 315/DIG. 5 X |
| 3,732,435 | 3/1972 | Strandberg, Jr. | 34/52 X |
| 3,740,859 | 6/1973 | Patton et al. | 34/52 X |
| 3,835,777 | 9/1974 | Krygeris | 101/350 |
| 3,841,216 | 10/1974 | Huffman | 101/181 |

*Primary Examiner*—Hugh R. Chamblee
*Assistant Examiner*—Paul J. Hirsch

[57] ABSTRACT

A mercury vapor electric discharge lamp is supplied with AC electric power, which is variable over a wide range, to control the lamp output power in the form of the intensity of the electromagnetic radiation emitted over a correspondingly wide range of from approximately 5% to 100% or better of rated output power without lamp extinction. An AC phase modulation control circuit controls the AC electric power supplied to the lamp such that applied voltage remains relatively constant while the current is controllably varied determined by the phase angle of conduction in the control circuit. Control of the AC phase modulation control circuit is effected in response to the actual output power of the electromagnetic radiation emitted by the lamp, the speed of a printing press or conveyor line with which the lamp may be used to cure ultraviolet sensitive inks, paints, plastics and the like on some form of substrate. Moreover, the actual lamp intensity, when below a called for intensity, may be used to control the speed of the press conveyor, process line and the like. Means also are disclosed to indicate, for example, lamp aging, press or process slow down and the like, and a lamp cooling blower is automatically controlled to vary the amount of cooling proportional to lamp output power.

7 Claims, 8 Drawing Figures

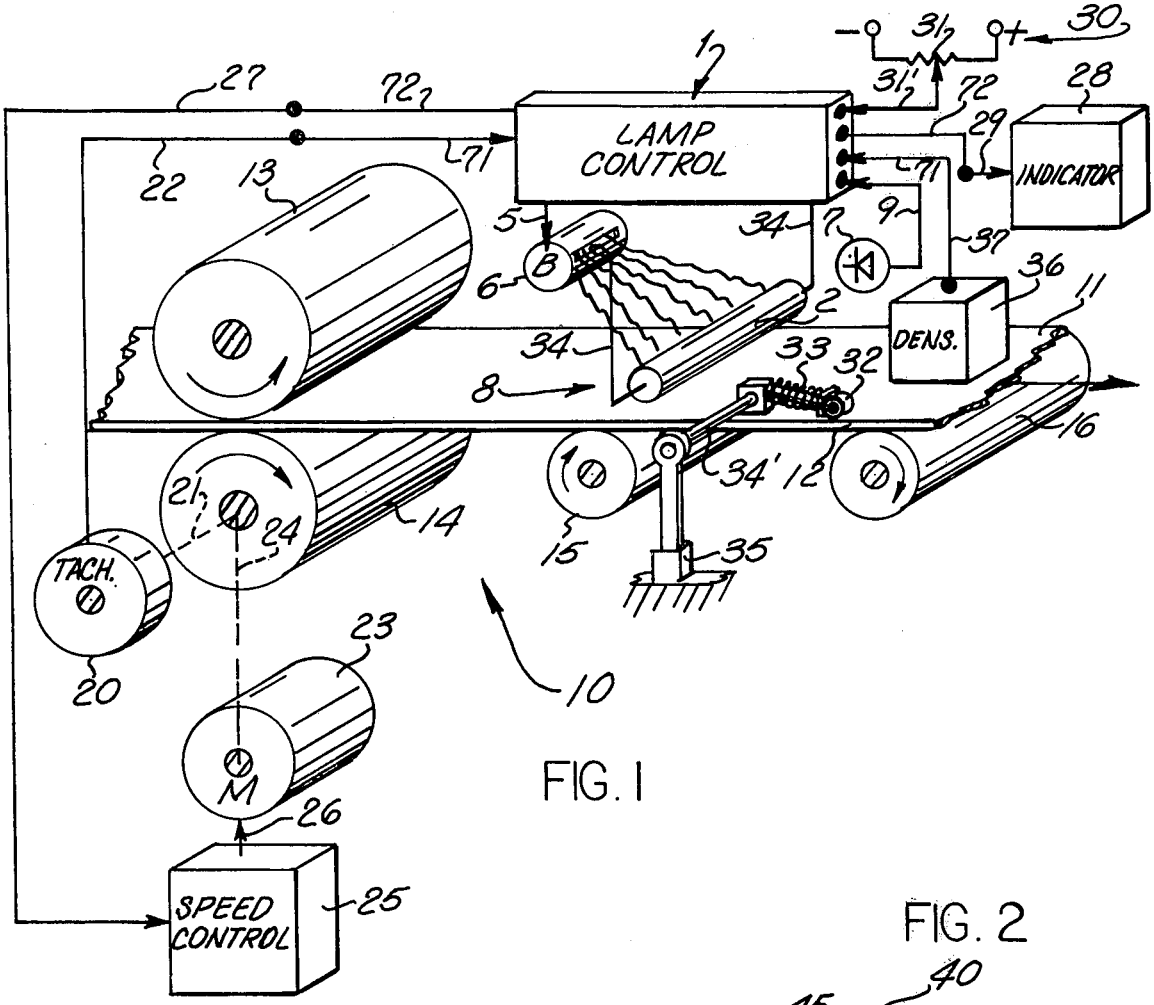
FIG. 1
FIG. 2
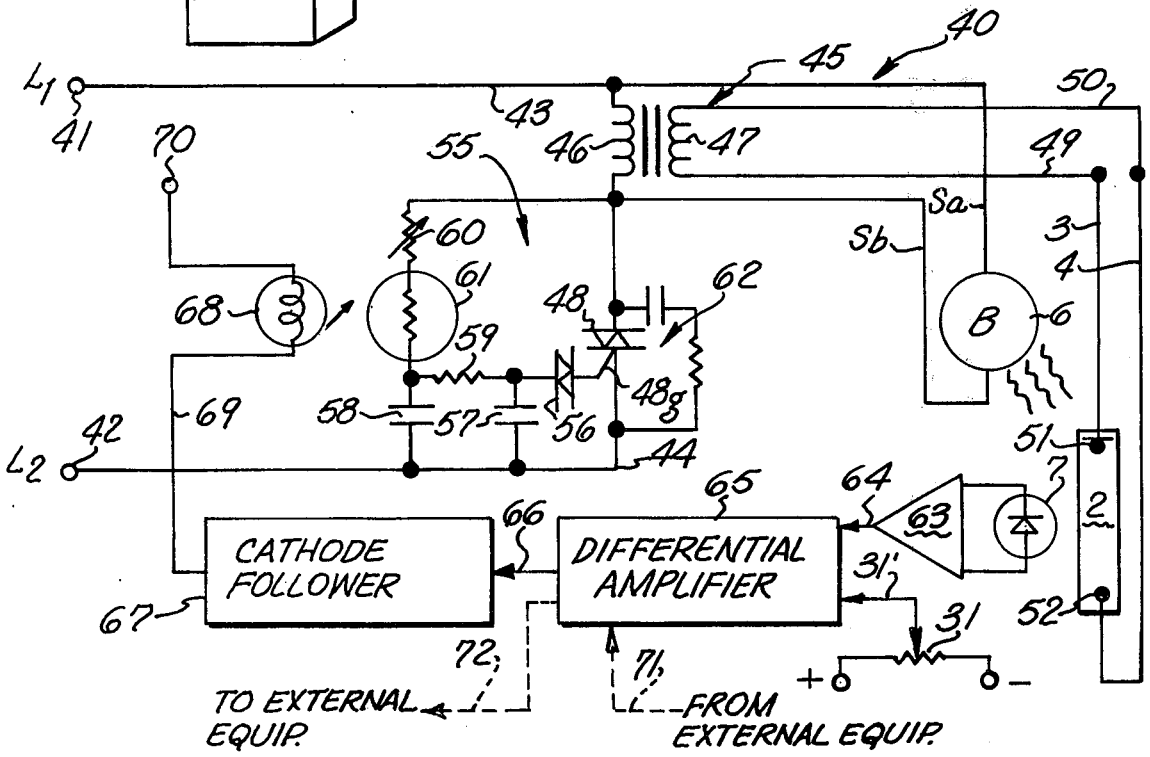

EXAMPLE OF POWER CHANGE TO 25% AND BACK TO 100%

WIDE RANGE POWER CONTROL FOR ELECTRIC DISCHARGE LAMP AND PRESS USING THE SAME

This is a division of application Ser. No. 532,172 filed Dec. 12, 1974.

BACKGROUND OF THE INVENTION

This invention relates to a power supply system for controlling the output power in the form of the intensity of electromagnetic radiation from an electric discharge lamp and, more particularly, is related to such a system that provides to the lamp AC electric power at suitable levels to avoid extinction of the lamp while controlling the output power over a wide range. Moreover, the invention is directed to such a power supply system and lamp used in conjunction with a conveyor printing press, or the like, with feedback signals being provided between the power supply system and the press equipment to interrelate the same for effective curing of printed material.

Ultraviolet and infrared electromagnetic radiation may be used to expedite the curing of certain inks or paints on surfaces of paper, metal, wood, plastic and the like. In the past conventional ballast circuits have been used to energize an electric discharge lamp at full power and at 70% power for such curing purposes with a large mechanical apparatus being required for any further attenuation of radiation short of lamp extinction. Such prior art ballast circuits vary both the lamp voltage and current with external ambient conditions. Design parameters of the ballast do not take into consideration the many variables which may occur in normal operation. The result of this internal problem will provide unstable operation of the lamp. Once the lamp is extinguished, time must be taken to allow the mercury to condense, then to reapply power to assume normal operation. Up to 8–10 minutes may be lost.

In an electric discharge lamp for curing ink or paint, it is important that a wide range of control of output power be available. For example, if a press were to slow down, it would be necessary to reduce the lamp output intensity, else the printed material may be burned. Similarly, if the press were to stop briefly, it is important that the lamp output be reduced to a minimum short of extinction, first, to avoid burning the printed material or the press web and, second, to avoid the need for a re-start and warm up period after the press is ready to begin again. Moreover, if the curing is not effective the lamp output intensity should be increased and if the called for intensity is not attainable, then the press or other conveyorized mechanic should be slowed. The conventional energization circuits for electric discharge lamps do not provide for such variations and controls, and since the conventional method of light attenuation is achieved mechanically, large space and heat dissipation requirements are necessary and a great deal of electric energy is wasted.

The instant invention will be described hereinbelow with reference to a variable AC power supply system for a mercury vapor electric discharge lamp that emits, upon energization, electromagnetic radiation at least in one or both of the infrared and ultraviolet spectral ranges that is useful for the curing of ink or paint on a substrate material. It is to be understood, however, that the variable AC power supply system may be used to control the power supplied to other types of electric discharge lamps to effect adjustable output power therefrom over a relatively wide range of, for example, from 5 to 100% of maximum output power.

In a mercury vapor electric discharge lamp, which usually comprises a sealed envelope having two interior electrodes an inert gas; e.g. argon, neon and a quantity of fluid mercury filling in liquid and/or vapor form, a high starting voltage applied across the electrode ionizes the inert gas within the tube. The heat developed by this plasma vaporizes the mercury. Steady state conduction of current between the electrodes and through the envelope will occur due to the thermal ionization of the mercury gas or vapor, with temperatures in excess of 3,600° K being generated in the plasma resulting in a large radial flow of thermal energy.

The mercury vapor electric discharge lamps have a negative resistance characteristic. At start-up a relatively high voltage is required to effect current flow between electrodes through a correspondingly high impedance of the molecules and ions therebetween. After the lamp has been started and voltage to the electrodes is briefly interrupted, a certain number of ions will remain within the envelope to effect conductions. Assuming voltage is re-applied before the extinction time has elasped, this voltage will create a field within the envelope sufficiently strong to sweep any thermionically emitted electrons through the gas, and continued application of such a voltage will re-establish the plasma arc through the envelope. After starting, the hottest gas would be toward the center of the lamp tube due to the radial flow of thermal energy, and this area would contain the largest number of positive ions, which would then be the best conductor with the corresponding result that the current density in this area would be the greatest within the tube. The current density would then continue to increase with a corresponding increase in temperature, which will generate more ions which will then further increase the conduction, the net effect being that less electrical energy, or voltage, is required to push the same number of electrons per unit time through the mercury arc as the total number of electrons per unit time is increased. This phenomena then is apparent as the negative resistance characteristic of the plasma arc are dynamic and are directly associated with the thermal and ionic equilibriums within the envelope.

SUMMARY OF THE INVENTION

In the instant invention the electric discharge lamp is in a series loop circuit with the secondary of a power coupling transformer, the primary of which is intermittently energized with any commercial power source; e.g., 220/440 volts, 50/60 Hz line voltage under control of a triac and AC phase modulation control circuit, and each time voltage is intermittently applied across the lamp electrodes, which lamp has not been allowed to go to extinction, the rate of change of current through the same is initially very large due to a charging of the area immediately surrounding the negative electrode forming an electron cloud about the same as electrons made available by thermionic emission are swept into this area. As the current between electrodes and through the plasma arc increases, its rate of increase decreases since the current flows through a relatively low impedance path.

It has been found that the leading slope or rate of change of the current wave form in each such intermittent energization is approximately the same regardless of the duty cycle, i.e. the delay along each half cycle of the line voltage that the triac is fired; and, therefore, the initial voltage across the lamp electrodes will always be about the same according to the formula $V=L(di/dt)$, since during such energization the applied voltage is limited by the rate of change of the current and the inductance in the series loop circuit. Moreover, when the line voltage is supplied at 60Hz and the triac is fired in each half cycle thereof, the lamp current amplitude will depend on the duty cycle and the lamp voltage will remain substantially constant no matter what the duty cycle because of the dynamic resistance of the lamp. The ultimate limit on the amount of current flowing in the series loop circuit in which the electric discharge lamp is connected is determined by the impedance of the plasma arc in the lamp envelope and the impedance of the power coupling transformer.

It has been found, however, that a reduced average current through the plasma arc will result in a corresponding slightly higher average voltage requirement, which is apparently due to the terminal dynamics of the lamp since the time constants associated with heating and cooling thereof are relatively small so as to influence the flow of current, especially when the current is supplied at 60 Hz. In fact, the temperature versus time curve for a sinusoidal input to an electric discharge lamp of the mercury vapor type lags the current versus time curve by approximately 18° because the current through the tube must not only heat the gas but also must supply the heat losses to the wall of the envelope; therefore, upon application of an AC voltage to the electrodes of an electric discharge lamp, the actual time required for the current to rise may be slightly longer than that required for the current to fall back to zero in each half cycle, which, of course, further maintains a relatively steady voltage level to the lamp during each duty cycle. The amount of voltage and current required for effective energization of the electric discharge lamp will be directly related to the temperature of the lamp so that lower average current settings will allow for more cooling of the lamp between duty cycles, which lowers the average conductivity of the lamp and, accordingly, requires a slightly higher voltage to maintain energization without extinction.

The AC power supply system of the instant invention may be used with low, medium, and high pressure electric discharge lamps, the power output capabilities of which are usually determined by the length of the lamp. The only principal modification to the instant power supply system for use with the various types of lamps would be to modify the voltages produced at the secondary output, for example, by changing a tap connection to the lamp. A medium pressure electric discharge lamp, which is most commonly used as a curing lamp in printing press systems, is usually rated at approximately 200 watts per inch of spacing between electrodes, and such lamps emit radiation over a wide, although not not necessarily continuous, spectrum from ultraviolet through visible to infrared. The spectral lines and percentages of the electromagnetic radiation emitted by such lamps may be changed depending, for example, on the type of quartz used for the envelope, the inert gases used for starting, eg. argon, helium, neon, etc., the mercury content of the lamp, and the voltage gradient.

Two conditions must be met for starting a conventional mercury vapor electric discharge lamp: first, sufficiently high voltage must be provided to the electrodes to ionize gas in the tube for starting the arc between the electrodes, such starting voltage being considerably higher than that required to operate the tube in steady state; and, second, once the gas in the tube is ionized effecting a very low resistance between the electrodes, the extremely high starting current developed as well as the high start voltage must be reduced in order to avoid damage to the lamp. The high starting current reduces in an exponential form as the mercury vaporizes, fast at first and then slower until the tube has come up to its normal operating point, which is reached when the heat generated by the current flow in the gases evaporates all the mercury and sufficiently heats the quartz envelope and electrodes.

When the electric discharge lamp is operating at full power, the self-heating is sufficient to maintain operation with extreme air currents circulating around the tube, which air currents are usually provided by a blower that especially maintains the electrode seals below 350° C to prevent physical destruction of the conductors. However, at reduced power levels of the lamp, the self-heating is correspondingly reduced, which may result in instability of the lamp if the circulating air remains at its initial high flow rate. Moreover, if the voltage to the lamp is changed faster than the various operating parameters of the lamp during a reduced power change, instability and complete deionization will result, as is mentioned above.

In the instant invention the primary circuit of a conventional power transformer of suitable EI characteristics to meet the lamp needs receives line AC electric power under control of a solid state switching device, such as a triac, which in turn is controlled by an AC phase modulation control circuit. The transformer secondary is coupled to the mercury vapor electric discharge lamp to energize the same at relatively constant voltage and widely adjustable currents for control of the output power of the electromagnetic radiation emitted therefrom. The intensity of energy of the electromagnetic radiation emitted by the lamp preferably is monitored so as to provide a feedback signal to control the AC phase modulation control circuit to maintain the radiation intensity at a predetermined constant level. Means are provided to set the mentioned predetermined level either manually or, for example, when the lamp is used to cure ink or paint, in response to the thickness thereof, speed of a conveyor, or printing press, curing effectiveness, or the like. Moreover, the AC power supply system for the lamp may be used to develop an output signal to reduce the speed of the conveyor or printing press, for example, to reduce the speed in the event that the maximum lamp intensity is inadequate to effect curing on any substrate moving at high speed, and a motorized blower for cooling the lamp also may be coupled to the AC power supply system to reduce cooling air currents to the lamp when the latter is operating at reduced power.

The AC power supply system of the invention, therefore, is capable of supplying energy to a mercury vapor electric discharge lamp so as to operate the same at output power levels in a range from approximately 5 to 100% or better of maximum power without allowing the lamp to go to extinction. Also, the various required starting conditions and parameters for a mercury vapor electric discharge lamp and the power circuit therefore, will automatically adjust for starting without requiring further electrical starting equipment.

Using ultraviolet electromagnetic radiation to cure or to dry ink, paint or the like, the curing can be done under controlled temperature, which facilitates curing on substrates that are sensitive to heat. Moreover, in the case of multicolor offset printing, for example, ultraviolet curing lamps can be placed in between stations to cure one color before the next is applied, which will eliminate carry-over of one color to the other, scratches, scuffs, and the like. The curing rate and sensitivity to ultraviolet radiation of such inks, paints and the like, depends on the chemical compositions thereof, the type and amount of sensitizer used, the type and amount of pigment or filling material etc. Also, the amount or energy of ulraviolet radiation required to effect complete curing usually increases exponentially with the depth or thickness of the material to be cured. Therefore, it is important to be able to control the energy or power output of the ultraviolet radiation over a relatively wide range in order to provide the most efficient curing of each respective material, while also making efficient use of electric power and increasing the longevity of the lamp, which may in some instances be operated at reduced power levels.

The advantages of ultraviolet curing also include reduction of air pollution since ultraviolet curable materials polymerize entirely and do not contain any solvent which would have to be discharged into the atmosphere. Also, an ultraviolet curing line is considerably shorter than the conventionally used gas oven, for the ultraviolet curable materials react extremely fast upon exposure to the ultraviolet radiation and there is no time lag as in the oven curing process wherein the coating temperature has to be raised sufficiently to induce curing. Further, there is a savings in labor, due to a reduced number of required processes and handling steps in that the cured material comes off the conveyor line ready to be handled; and finished wood and/or particle board panels come off the curing line at a relatively low temperature enabling the same to be stacked or further processed immediately. A further application is in processing of light sensitive materials such as printing plates, certain photographic printing, printed circuit materials, photosensitive metals for signs, decoration, nomenclature and the like where the material to be processed is normally held stationary. The continuous control and regulation of the electromagnetic radiation applied results in uniform processing in spite of tube aging, line voltage variations and the like.

With the foregoing in mind, it is a primary object of this invention to control over a relatively wide range the electromagnetic radiation output power from an electric discharge lamp.

Another object is to vary the amount of external cooling supplied to an electric discharge lamp in response to variations in electrical input power to the latter.

A further object is to increase the longevity of an electric discharge lamp.

Yet another object of the invention is to maintain relatively stable operation of an electric discharge lamp when energized at less than full power.

Yet an additional object of the invention is to eliminate or at least to reduce curling in an electric discharge lamp.

Yet a further object is to control the speed of a printing press or the like in response to the power output of a curing lamp.

Still another object of the invention is to control the power output of a curing lamp in response to the speed of the printing press.

Still an additional object of the invention is to control the intensity of a printing press or conveyor line curing lamp or lamps in response to the curing affect on printed material.

Still a further object of the invention is to reduce the space requirement for printing presses using curing lamps; to reduce the cost of such printing presses and curing lamp equipment; to conserve electric energy used therein; and to reduce air pollution from evaporating solvents.

These and other objects and advantages of the present invention will become more apparent as the following description proceeds.

To the accomplishment of the foregoing and related ends, the invention, then, comprises the features hereinafter fully described, the following description and the annexed drawings setting forth in detail an illustrative embodiment of the invention, this being indicative, however, of but one of the various ways in which the principles of the invention may be employed.

BRIEF DESCRIPTION OF THE DRAWINGS

In the annexed drawings:

FIG. 1 is a schematic block diagram of the AC power supply system of the invention used as a lamp control in relation to a conventional printing press apparatus and the same equipment may be used on any conveyor line operation;

FIG. 2 is a schematic electric circuit diagram, partially in block form, of the AC power supply system of the invention;

DESCRIPTION OF THE PREFERRED EMBODIMENT

Figure 3:
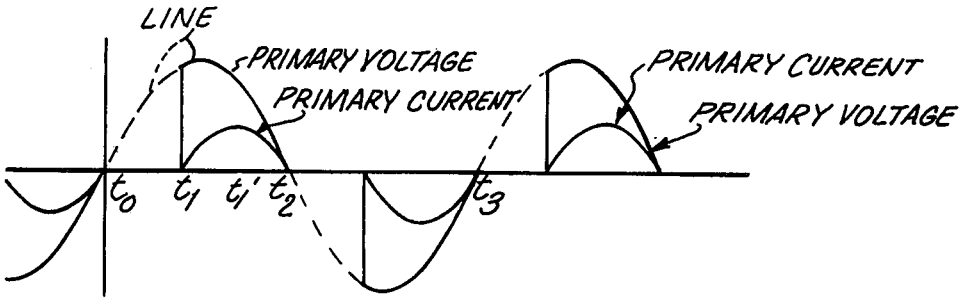
FIG. 3 is a graph of the voltage and current wave forms in the secondary of the power coupling transformer with triac control.

Referring now to the drawings wherein like reference numerals designate like parts in the several figures, the AC power supply system of the invention is generally indicated at 1 in the form of a lamp control in FIG. 1. The lamp control 1 provides a principal AC electric power signal to an electric discharge lamp 2, which may be of the mercury vapor type, via a pair of conductors 3, 4. The lamp control also provides electric power via a line 5 to energize the electric motor of a conventional blower 6, which is positioned with respect to the lamp 2 to provide cooling air currents thereto. A radiation sensitive detector 7 is also positioned with respect to the lamp 2 in order to monitor the intensity of the electromagnetic radiation generally indicated at 8 emitted therefrom, and the detector 7 provides on the line 9 an input to the lamp control 1.

In the preferred form of the invention the lamp 2 is a curing lamp, which emits electromagnetic radiation in the ultraviolet region of the spectrum, and the lamp is positioned with respect to a conventional printing press or any conveyor line operations, which is generally indicated at 10, to direct ultraviolet radiation onto the surface 11 of sheet material 12 on which ultraviolet curable ink or paint is cured or other printed matter is printed, for example, at the rollers 13, 14, as in a conventional printing press. A further pair of support rollers 15, 16 are positioned to support the sheet material 12 in a relatively fixed plane with respect to the lamp 2.

A tachometer electric signal generator 20 is coupled by a linkage 21 to the roller 14 and provides in conventional manner an electric tachometer signal to the lamp control, which signal is proportionally representative of the rotational speed of the roller 14, and, accordingly, the linear speed of the sheet material 12 through the press. Such tachometer signal may be utilized in the lamp control 1 to adjust the input power to the lamp and the output power therefrom in the form of the intensity or energy level of the ultraviolet radiation emitted thereby. Therefore, if the linear speed of the sheet material 12 were relatively fast, the intensity of the radiation from the lamp 2 would be relatively great; whereas, for slower speeds of the sheet material 12, the lamp control 1 automatically may reduce the lamp intensity to avoid burning the sheet material as well as to conserve electric energy and causing distortion of the conveying apparatus or rollers. Although the tachometer 20 is depicted coupled by the linkage 21 to the roller 14, it may be coupled to any other mechanical portion of the press 10 to provide a signal on the line 22 proportionally representative of the linear speed of the sheet material 12.

A motor 23 is coupled by a linkage 24 to drive the roller 14, and the motor also may be coupled to other portions of the press 10 which require mechanical driving. A conventional speed control 25 is coupled by a line 26 to the motor 23 in order to control rotational speed thereof, the speed control being any conventional circuit, for example, for controlling the power signal to the motor, or the like. An output from the lamp control 1 is provided on the line 27 as an input to the speed control 25 in order to control the speed of the motor 23 and, accordingly, that of the roller 14 and sheet material 12, in response to the output power of the lamp 2, as monitored by the detector 7. Therefore, in the event that the radiation output from the lamp 2 reduces, for example, due to aging of the lamp, the press 10 may be automatically slowed so that the printed matter on the sheet material 12 will be fully cured without having to fully shut-down the press in the middle of a printing operation. Also, one or more indicators designated at 28 are coupled to the lamp control 1 by a line 29 to provide, for example, physical indications in the form of illuminated lamps or the like of reduced press speed, uncalled for reduced output power of the lamp 2, as well as other faults that might occur in the lamp control 1 and/or the press 10.

As described above, the ultraviolet radiation emitted by the lamp 2 has a curing effect on the printed material on the surface 11 of the sheet material 12, and a manual adjustment 30 may be provided for adjusting the lamp control so as to energize lamp 2 to provide ultraviolet radiation at a specified output power for ensuring complete curing of the particular printed matter used at any given time. Such a manual adjustment 30 may be provided by a potentiometer 31 connected across a DC power supply to provide a selected signal on the line 31′ as an input to the lamp control 1.

However, it may be desirable to automate the setting of the lamp control 1 so that the lamp intensity is adequate for curing particular printed matter, and such automation may be effected using an offset finger roller 32, which applies constant pressure to a portion of the sheet material 12 to smudge any paints or ink together. The finger roller may be mounted, for example, by a cantilever spring 33 onto an arm 34, which is attached to a fixed support 35. Conventional densitometers are positioned with respect to the sheet material 12 so as to view the portion of the surface 11, on which UV ink or paint is used on material 12, one ahead of the finger roller 32, the second following the finger roller 32. The second densitometer is synchronized to compare the first densitometer reading of the same area. The amount of smudging will provide the error signal to correct for lamp output or speed control as necessary. The densitometer sensor 36 and 36A may be in the form of a reflective type or transmission type densitometer although they are shown as the former type which includes a light source and photosensitive device that responds to light directed onto the viewed possibly smudged area to produce an error signal on the line 37 for effecting operation of the lamp control 1 to provide a larger output power from the lamp 2 when any smudging has occurred. The signal on the line 37 from the densitometer also may cause the lamp control 1 to reduce the output power of the lamp 2 when no smudging has taken place to a point just above where a smudging occurs; thus, the output power of the lamp 2 may be maintained at an optimum level for effective curing while conserving electric power and increasing the effective life of the lamp by operating the same at reduced power levels when possible.

It is also noted that up to a saturation point the rate of ultraviolet curing is usually directly proportional to the intensity of the ultraviolet radiation as well as inversely proportional to the thickness of the printed matter. Therefore, it is desirable to concentrate the ultraviolet radiation over a narrow area, whether generated by one or more lamps, than to spread the same, for most efficient curing.

Turning now more particularly to FIG. 2, the AC power supply system of the invention, which in effect constitutes the lamp control 1, is generally indicated at 40. The system 40 includes a pair of input terminals 41, 42, which are preferably adapted to be coupled directly to the two lines of a 440 volt 60 electric service from the utility company in order to supply power on the lines 43, 44 to the various portions of the system. The power supply system 40 also includes a power coupling transformer 45, which has a primary winding 46 and a secondary winding 47, the former being connected at one terminal to the line 43 and at the other terminal via a controlled bidirectional switch 48, which is preferably in the form of a triac, to the line 44. The secondary winding 47 is coupled by the lines 49, 50 to the two electrodes 51, 52 of a conventional mercury vapor electric discharge lamp 2 in a series loop circuit therewith. The blower 6 is connected by the lines 5*a*, 5*b* across the two terminals of the primary winding 46 in order to receive average electric power that is directly proportional to the power transferred in the transformer 45.

The triac 48 is the active controlled switching element of an AC phase modulation control circuit 55, which is operable to control the amount of electric power transferred by the transformer 45 to energize the lamp 2. The control circuit 55 includes a two terminal bidirectional switch 56, such as a diac, that exhibits high impedance and low leakage current characteristics until the applied voltage from a capacitor 57 reaches the break-over point. The diac is coupled between the gate terminal 48*g* of the triac 48 and a time constant circuit, which includes a pair of capacitors 57, 58 and a resistor 59, which circuit is controlled by a manually adjustable resistor 60 and a photosensitive resistor 61. The elements of the control circuit 55 cooperate and operate in conventional manner so that when the voltage on the capacitor 57 reaches the breakover voltage of the diac 56, the latter fires to provide a gate signal to the triac 48 effecting conduction therein and discharing the capacitor 58. Since the triac 48 is used to control an inductive load, i.e. the transformer 45, voltages with a high rate of change ($dv/dt$) can be generated, which could potentially cause a non-gated turn on of the triac; therefore, a conventional resistor and capacitor snubber circuit 62 is coupled across the two main electrodes of the triac 48 to reduce the $dv/dt$ stress to which the triac may be subjected.

The radiation sensitive detector 7 is preferably in the form of a photosensitive diode, which responds to ultraviolet radiation, and such detector is coupled to an amplifier 63 that provides on the line 64 an output signal which is proportionally representative of the intensity or energy level of the ultraviolet radiation emitted by the lamp 2. The line 64 is coupled as one input to a conventional differential amplifier 65, which compares the signal on the line 64 with a manually adjusted bias signal provided on the line 31' from the manually adjustable potentiometer 31. An output control signal from the differential amplifier 65, which is proportional to a comparison of the input signals on the lines 31' and 64, is provided on the line 66 to the input of a conventional cathode follower circuit 67, which may be in the form of a single transistor, that controls conduction through and the intensity of light emitted by a lamp 68.

The lamp 68 is connected to the cathode follower by line 69 and to a source of unidirectional electric energy at a terminal 70. The signal on the line 69 and the intensity of light emitted by the lamp 68 are proportional to the output control signal of the differential amplifier 65. Moreover, the resistance of the photosensitive resistor 61 to which the lamp 68 directs light will, accordingly, be proportional to the intensity of such light. Thus, it should be understood that the intensity of the light emitted by the lamp 68 will be proportionally related to the ultraviolet radiation intensity from the mercury vapor electric discharge lamp 2.

One or more additional inputs may be supplied to the differential amplifier 65, as is indicated in the dotted line 71 labeled "from external equipment", such as from the densitometer 36 via line 37 or tachometer 20 via line 22. Therefore, a signal supplied on the line 71 also may be included in the comparison made in the differential amplifier 65 to result in an increase or decrease in the output control signal therefrom on the line 66 to call for a greater or lesser output power from the lamp 2. Further, an output from the differential amplifier 65 may be coupled to control external equipment, such as, for example, the speed control 25 and the indicators 28 illustrated in and described with reference to FIG. 1, and such connection is shown in dotted line in FIG. 2 at 72, which is labeled "to external equipment".

In operation of the AC power supply system 40, a 220/440 volt, 50/60 Hz AC power signal is supplied to the terminals 41, 42 from the utility company, and the wave form of such voltage is depicted partially in solid and partially in dotted lines as the smooth flowing continuous sinusoidal curve "Line" illustrated in FIG. 3. One positive half cycle of the line voltage may be found between the times $t_0$ and $t_2$ on the graph of FIG. 3, and the next negative half cycle may be found between the times $t_2$ and $t_3$.

The AC phase modulation control circuit 55 determines when a gating signal will be applied to the gate terminal 48*g* of the triac 48 causing the same to conduct current and to apply the line voltage across the two terminals of the primary 46 of the power coupling transformer 45. As depicted in FIG. 3, such gating signal is supplied at time $t_1$, which is approximately half way into the mentioned positive half cycle of the line voltage between $t_0$ and $t_2$, and at that time the voltage across the primary 46 jumps to the instantaneous line voltage. The current through the primary 46 cannot rise instantaneously due to the inductive nature of the primary; and, therefore, the wave form of the current in the primary will appear, as is illustrated in FIG. 3, on the order of a half sinusoid commencing when the triac 48 is fired and terminating when the polarity of the line voltage reverses at time $t_2$. Similar voltages and currents of opposite polarity will occur in the primary on the negative half cycle of the line voltage signal, as is illustrated in FIG. 3, say from time $t_2$ to time $t_3$.

The phase modulation control circuit 55 therefore detemines the phase angle of the line voltage at which the triac 48 is fired to conduction. This phase angle determination is achieved in conventional manner using the time constant circuit, which includes the capacitor 57, 58, resistor 59, adjustable resistor 60, and photosensitive resistor 61. Assuming that the adjustable resistor 60 is used only for calibration, say at the factory, the resistance thereof will remain relatively fixed during use, and, therefore, the time required for sufficient voltage to accumulate on the capacitor 57 to break-over the diac 56 will be determined by the resistance of the photosensitive resistor 61, which is responsive to the intensity of the light emitted by the lamp 69. Thus, the phase angle of the line at which the triac 48 is fired is variable proportionally with the resistance of the photosensitive resistor 61.

Figure 4:
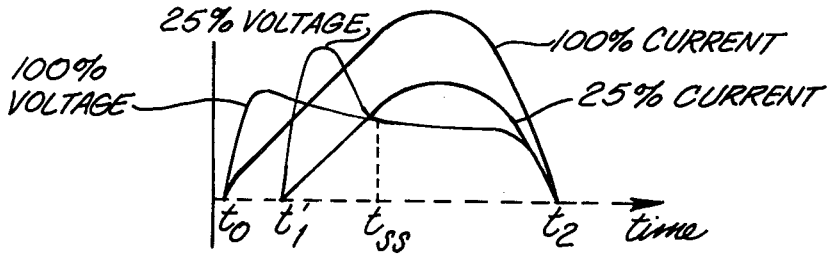
FIG. 4 is a graph of the voltage and current wave forms in the secondary of the power coupling transformer and electric discharge lamp for 100 and 25% duty cycles utilizing triac control, the time between $t_0$ and $t_2$ and the time between $t_1$ and $t_2$ being, respectively, the duration of 100 and 25% duty cycles.

It has been found that regardless of whether the triac 48 is fired early in each half cycle of the line voltage or late in each half cycle, the leading and trailing edges of the current wave forms developed in the secondary 47 of the power coupling transformer 45 and supplied to the electrodes 51, 52 of the electric discharge lamp 2 will be substantially parallel, as is illustrated, for example, in the graph of FIG. 4. In the curve labeled "100% current" the triac 48 is fired and the secondary current and voltage begin to rise right at time $t_0$, which can be seen in FIG. 3 as the time when the line voltage beings its positive rise in one half cycle; and the secondary current and voltage wave forms go to zero at time $t_2$, which also corresponds to $t_2$ of FIG. 3. It is noted that the time during which the secondary current rises to its maximum level is longer than the time during which the current falls back to zero due to the above discussed reasons concerning the required heating of the electric discharge lamp envelope and the gases therein that must be accomplished by the current flowing through an electric discharge lamp.

The wave form of the voltage occurring across the terminals of the secondary 47 is labeled "100% voltage" in FIG. 4. Since the initial voltage is determined by the formula $L_{dt}^{di}$ , i.e. the product of the circuit inductance and the differential of the initial current with respect to time, the voltage will rise rather rapidly; and upon application of such voltage to the lamp electrodes 51, 52 current will flow through the plasma arc of the electric discharge lamp with increasing ease as the resistance of the latter decreases. The dynamics of the resistance and temperature time constants and coefficient will be such that the voltage at the electrodes 51, 52 will remain relatively constant during each duty cycle.

In FIG. 4 the wave form of the secondary current that would occur if the triac 48 were fired to effect a 25% power output, i.e. at time $t_1$ of FIG. 3 is labeled "25% current. " The average of the time intergral of the product of the volts ampere curves will yield the result 100% power or 25% as the case may be. The voltage occurring across the terminals of the secondary 47 and the electrodes of the lamp 2 when the triac is fired at a phase angle of the line voltage when the power dissapated by the lamp is 25% of rated; i.e., at time $t_1$ rises along a substantially parallel slope with the voltage illustrated in the 100% voltage curve; however, the 25% voltage curve rises to a level slightly higher than the 100% voltage on initial turn on due to the higher instantaneous value of voltage applied by the power line. In fact all initial turn on voltages rise to the value of the applied power line voltage and then fall back to a relatively constant level due to the dynamic resistance and temperature time constants of the lamp 2, whereby the lower current will require a higher voltage for sufficient ionization in the lamp and "to push" the current therethrough. It can be seen, however, that at time $t_{ss}$, when the plasma arc in the lamp 2 has become constant, the 25% voltage curve joins the 100% voltage curve in FIG. 4. From the foregoing, it will be understood that regardless of whether the triac is fired early or late in each half cycle of the line voltage the applied voltage across the electrodes 51, 52 of the lamp 2 will always be approximately the same, and the only substantial variable will be in current.

Figure 5:
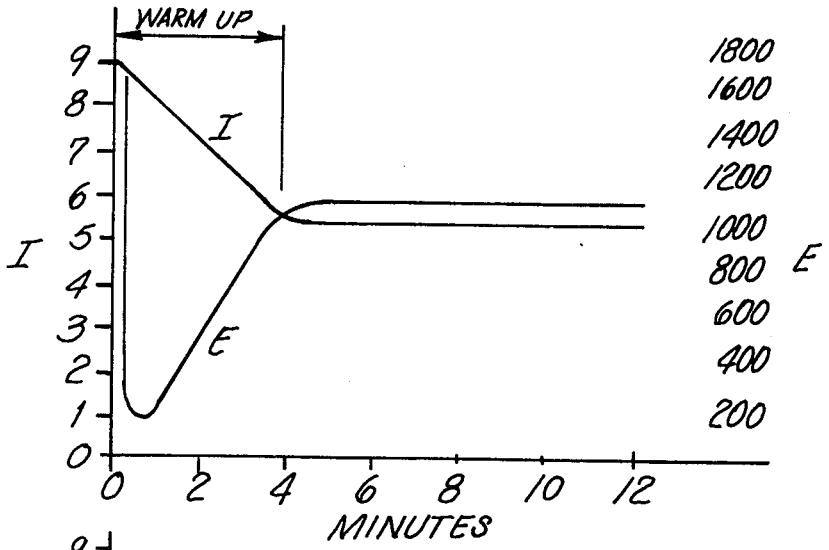
FIG. 5 is a graph of the typical voltage and current wave forms in a conventional mercury vapor electric discharge lamp during starting and warm-up to maximum power.

In starting a conventional mercury vapor electric discharge lamp using a conventional ballast control, a relatively high voltage is required to ionize the mercury, and upon such initial ionization a very high current flows through the lamp. Thereafter, the current must be reduced to avoid damage to the lamp, and the voltage, which initially reduces, must be raised up to a normal operating level. A graph illustrating the starting voltage E and the starting current I in a mercury vapor electric discharge lamp started by a conventional ballast control is illustrated in FIG. 5. It can be seen that it takes approximately 4 minutes for the voltage and current to stabilize at a normal operating level, at which time the lamp is at proper operating temperature and emits electromagnetic radiation at 100% output power.

To start a mercury vapor electric discharge lamp 2, using the AC power supply system 40 of the instant invention, however, the AC power signal line voltage is supplied to the terminals 41, 42 and the manual adjustment potentiometer 31 is adjusted to a start position calling for minimum output power from the lamp 2, whereby the output control signal on the line 66 from the differential amplifier 65 will be relatively small, and the intensity of the light emitted by the lmap 69 will be correspondingly small. Therefore, the resistance of the photosensitive resistor 61 will be relatively large, and the time required for the voltage on the capacitor 57 to achieve the break-over voltage of the diac 56 will be relatively far into the applied half cycle of the line voltage. The phase angle of the line voltage at which the triac 48 fires is, thus, relatively small, and any current that might flow in the secondary 47 will be correspondingly small, although the voltage will be at the relatively fixed level as described above. It will be understood, therefore, that the AC power supply system 40 provides a cooperation among elements such that the starting current in the lamp 2 is inherently low to avoid damage to the lamp, and no additional start circuitry is required.

Assuming the lamp 2 has been started, the potentiometer 31 may be adjusted to any position to effect maximum or minimum output power in the form of the intensity of the electromagnetic radiation emitted by the lamp. If the intensity is set, for example, at 50% output power, the output control signal on the line 66 from the differential amplifier 65 will cause an increase in illumination of the lamp 69, which will cause the resistance of the photosensitive resistor 61 to drop and the triac 48 will be fired earlier in each half cycle of the line voltage to increase the duty cycle of the lamp. The intensity of the radiation from the lamp 2 is monitored by the detector 7 which provides a control reference signal to the differential amplifier indicative of such intensity, and as the intensity comes up to the level called for by the potentiometer 31, the differential amplifier 65 compares the reference control signal and the signal from the potentiometer and will automatically adjust its output control signal on the line 66 to maintain the illumination level of the lamp 69 to keep the intensity of the lamp 2 at the level called for by the potentiometer 31. It is noted that although the detector 7, amplifier 63, differential amplifier 65, cathode follower 67 and the electro-optical isolator, including the lamp 69 and photosensitive resistor 61, form a loop feedback circuit for automatic control of the AC electric power supplied through the transformer 45 to the electric discharge lamp 2, the adjustable power supply may be readily simplified to eliminate the automatic feedback feature by eliminating such elements and substituting a fixed resistor for the photosensitive resistor, whereby the AC power supply system then may be manually adjustable using the variable resistor 60.

Moreover, since the blower 6 is coupled across the primary 46 of the power coupling transformer 45, the intensity of the air currents directed thereby onto the lamp 2 is varied proportional to the amount of power supplied to the lamp, which is, of course, determined by the phase angle at which the triac 48 is fired. Therefore, more cooling is applied to the lamp 2 when it is operated at high power and has a large amount of self-heating; whereas a smaller amount of cooling is applied to the lamp when it is operated at lower power, at which time it has a reduced amount of self-heating. By so adjusting the cooling applied to the lamp, the latter is maintained at a relatively constant high temperature for the most efficient and stable operation thereof regardless of the operating power level.

The output power from or intensity of electromagnetic radiation emitted by the lamp 2 will be proportional to the input power to the same, and using the power supply system 40 for energization of the lamp, the input power may be varied on the order of from 100% of the lamp power rating down to approximately 5% thereof. It is, of course, known that it is desirable to operate such a lamp below its maximum power rating when possible to increase the longevity thereof. The power to the lamp 2 is adjustable in current I, while the voltage B across the lamp electrodes is maintained relatively constant, as is depicted, for example, in the graph of FIG. 6. Using the instant invention a medium pressure 42 inch mercury vapor electric discharge lamp, which has a 200 watts per inch rating an the total power rating of 8,400 watts, may be operated after any warm up period, for example, at full voltage and maximum current to achieve a corresponding maximum output power.

Figure 6:
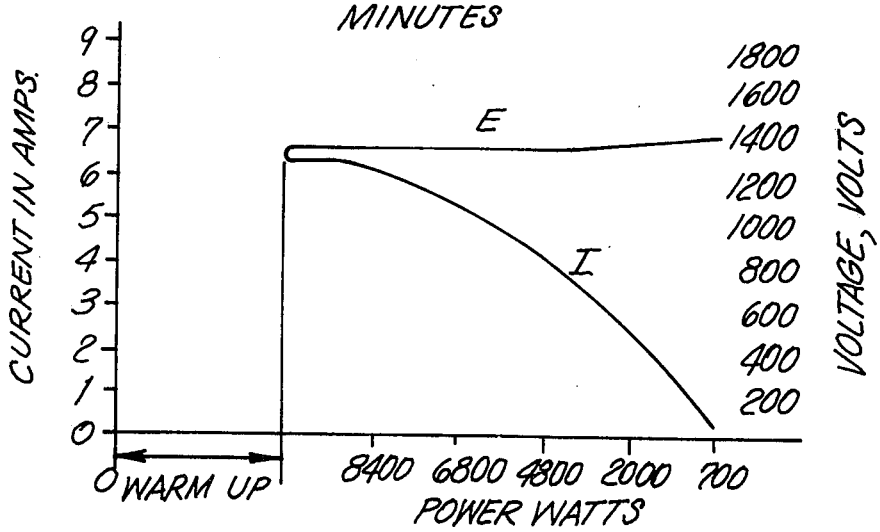
FIG. 6 is a graph illustrating the voltage and current wave forms of a mercury vapor electric discharge lamp energized at a wide range of power levels using the AC power supply system of the invention.

In order to reduce the lamp input power and, accordingly, its output power, the phase angle at which the triac 48 is fired is reduced to reduce the duty cycle of the lamp, and, accordingly, the current to the same, as is illustrated by the current I in FIG. 6 such that the input power may be adjusted all the way down to on the order of from 500 to 700 watts. The voltage E in FIG. 6, which is supplied to the lamp 2, remains relatively constant at approximately 1100 to 1300 volts, the higher voltage occurring at the lower power levels for the reasons described above.

It has been found that using a 60 Hz power applied to the terminals 41, 42 and effectively 120 Hz firing of the lamp 2, the latter will be operable all the way down to the very low mentioned power levels without going to extinction. Moreover, the reduction of blower speed and the maintained constant voltage level will effect relatively stable lamp operation even at the mentioned low power levels. Since the lamp 2 is energized using AC power, undesirable pitting of the electrodes 51, 52 is substantially reduced or eliminated because thermionic emission alternately occurs at the respective electrodes depending on the instant polarity of the AC electric power. It has also been found that undesirable curling, which is caused by standing longitudinal waves in the plasma, has been reduced or eliminated using the phase angle primary control as opposed to the conventional ballast energizing systems for electric discharge lamps.

When the electric discharge lamp 2 is used as a curing lamp in conjunction with a printing press 10 or other conveyor line installation, as illustrated in FIG. 1, the AC power supply system 40 provides the lamp control 1. Upon start up of the press, the roller 14 will rotate relatively slowly, and the tachometer control signal on the line 22 will be relatively low. The signal on the line 22 will be applied, for example, on the line 71 as an input to the differential amplifier 65 in the power supply system 40 of the lamp control 1 to cause a relatively low output power or intensity from the lamp 2. However, as the press or other conveyor line increases in speed, the tachometer control signal will increase and will cause a corresponding increase in the output power of the lamp 2 by increasing the output control signal from the differential amplifier 65 in the manner described above. Therefore, when the press or other conveyor line is operating at slow speed, the lamp 2 will not be energized at an unnecessarily high power level, but rather is operated at a power level just suitable for curing the printed matter on the sheet or other material 12; and as the press increases in speed, the lamp intensity will increase a corresponding amount.

The densitometer 36, which monitors the curing effectiveness, will view the surface 11 of the sheet material 12 to determine whether the roller 32 has produced a smudge error signal indicative of the same on the line 37, which also may be coupled as an input 71 to the differential amplifier 65, to increase the intensity of the electric discharge lamp 2 when printed or other material has been smudged. In the event that an error signal has been produced due to smudging, the lamp control 1 already has called for energization of the lamp 2 at maximum intensity, the differential amplifier will compare the densitometer signal and that from the detector and will then supply a signal, for example, at the output 72 thereof, which is coupled to the line 27 to the speed control 25, for slowing the motor 23 and the press until the speed of the sheet material is sufficiently slow to ensure effective curing of the printed matter. Occurrence of the latter condition where the lamp control effects reduction in the press speed implies a fault condition in the lamp control 1, the lamp 2, the press 10, etc., and, the line 72 also may be coupled to the indicators 28 via line 29 to provide a visual indication of the occurring fault. A similar reduction in press speed and fault indication may be effected by the lamp control 1 if the tachometer control signal causes the lamp control to call for a greater output power from the lamp 2 than is possible, for example, due to aging of the lamp.

Figure 7:
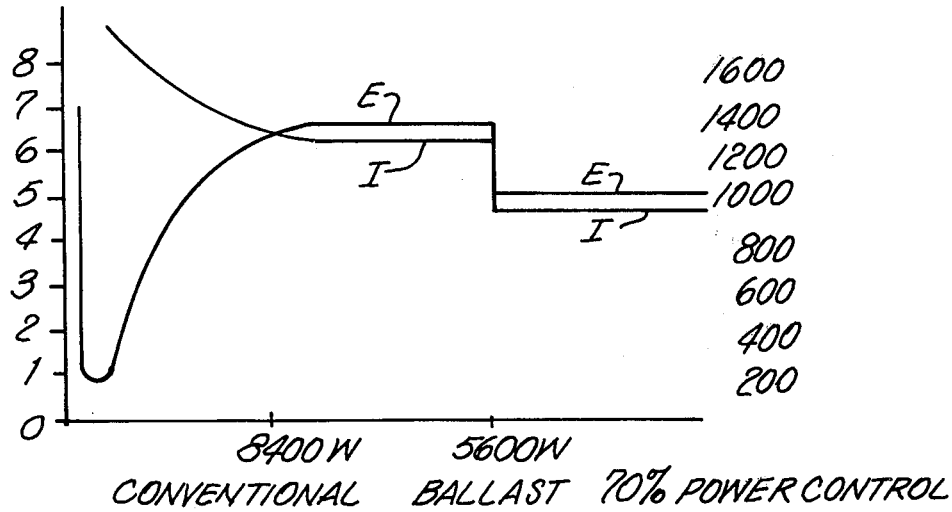
FIG. 7 is a graph of the voltage and current wave forms in a mercury vapor electric discharge lamp energized at starting and warm up, 100% power and 70% power by a conventional ballast control.

In a conventional ballast control circuit for a mercury vapor electric discharge lamp using in conjunction with a printing press, for example, the input power to the lamp may be supplied at 100% power or at a reduced power of 70% maximum, as is illustrated, for example, in the graph of FIG. 7. In such conventional ballast control circuits after the lamp has warmed up, it operates at, say, 8,400 watts and constant current and constant voltage, as is indicated by the curves I and E, respectively. When it is desired to reduce the lamp output power, the input power thereto is dropped to 5,600 watts, which is achieved by reduction in both the voltage and current.

In the instant invention, however, whenever it is desired to reduce the lamp output power, only the current is reduced, while voltage remains substantially constant. Therefore, the instant invention provides not only a wide range of power control, but also provides for maintained stable operation of the electric discharge lamp 2.

An important advantage of the AC power supply system of the invention used to energize and electric discharge lamp 2, the radiation from which is directed onto sheet material 12 for curing printed or other matter thereon, is that whenever the press 10 slows down, the intensity of the electromagnetic radiation may be reduced a corresponding amount. In fact, it has been found that when the lamp 2 is operated at 5% power the electromagnetic radiation, and especially that in the infrared range of the spectrum, will not burn the sheet material 12 when exposed for extended periods. Moreover, as soon as the press is again started or is driven up to speed after a relatively brief slow down or shut down, the lamp intensity will be increased automatically without any re-starting and thus a reduced warm up time being required for the lamp.

On the other hand, when a conventional ballast control is used to energize a mercury vapor electric discharge lamp to emit radiation for curing ultraviolet inks or paints, if the conveyor or press were to slow to a speed that would require the lamp to be energized between 100 and 70% output power for effective curing, the lamp would be operated at 100% causing inefficient use thereof, large amounts of unnecessary heat, and wasting of electric energy. Moreover, if the press or conveyor were to slow to a speed at which less than 70% output power were required from the lamp for effecting curing, still further energy would be wasted because the lamp would have to be operated at the 70% power level. If the press or conveyor were to drop still further such that irradiation of the sheet material 12 passing under the lamp 2 at such a slow speed would cause burning of the sheet material, the lamp 2 would have to be shut down; and upon restarting the press a 4 to 8 minute warm up period again would be required for the electric discharge lamp before it could be used to cure effectively the printed matter.

Figure 8:
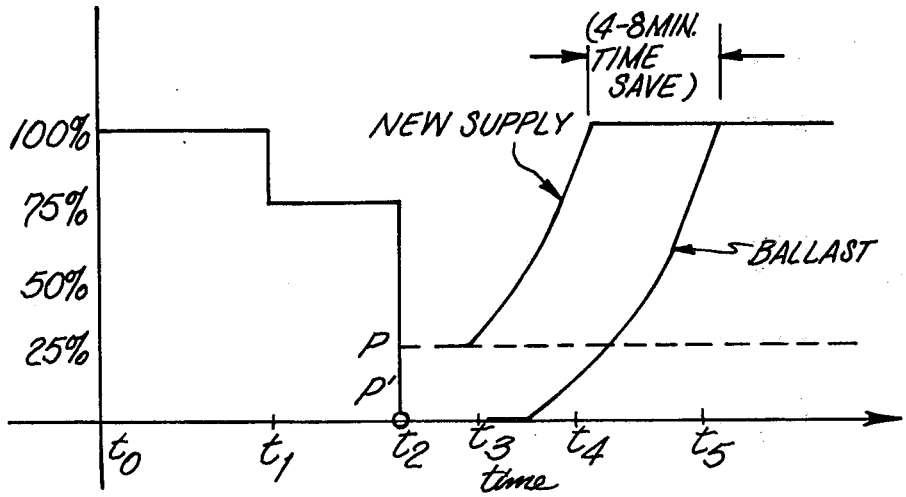
FIG. 8 is a graph depicting the different power outputs of a mercury vapor electric discharge lamp when energized by the AC power supply system of the instant invention and when energized by a conventional ballast control.

In FIG. 8 the advantage of wide range power adjustment using the instant invention as opposed to the two step power adjustment of conventional ballast control circuit is demonstrated. Either the instant invention or the conventional ballast circuits may be used to energize the electric discharge lamp 2 at 100% power, for example, as is illustrated at time $T_0$ through time $T_1$ on the graph, as well as to energize the lamp at 70% power, for example as is illustrated between time $T_1$ and $T_2$. However, when less than 70% output power is required from the electric discharge lamp at time $T_2$, the instant invention may be used to reduce the lamp output power to, say, the 25% level, which is indicated at point P, and to maintain that level until full power is again required of the lamp commencing at time $T_3$ with a relatively small lag in increasing power occurring between time $T_3$ and $T_4$. On the other hand, it can be seen from the graph of FIG. 8 that the conventional ballast circuit would shut down the lamp 2 at time $T_2$ when less than 70% power is tolerable, and the lamp then would remain off until time $T_3$ when full power is again called for. However, a 4 to 8 minute starting and warm up time is now required for the electric discharge lamp, which has been shut down and which accordingly will not be operating at full power until time $T_5$.

Therefore, when the instant invention is used in conjunction with a printing press or conveyor line operation, a relatively brief press slow down or stoppage does not require lamp shut down, and the press can be restarted virtually immediately at any time in that minute period. Also, the lamp 2 may be operated at its most efficient output power lever for effective curing of printed matter on the sheet material 12 without wasting electric energy and generating unnecessary heat while also increasing the longevity of the electric discharge lamp.

The embodiments of the invention in which an exclusive property or priviledge is claimed are defined as follows:

1. In a printing press for printing electromagnetic radiation curable printed matter on sheet material and an arc discharge lamp for emitting electromagnetic radiation to effect curing of the printed matter, apparatus for controlling the energization of said lamp comprising:

a transformer having a primary winding and a secondary winding;

means for connecting said secondary winding to said lamp;

A.C. power supply control means for connecting said primary winding to A.C. power supply lines for supplying A.C. voltage to said lamp through said transformer of sufficient amplitude to ionize the gas in said lamp so that said lamp fires to emit electromagnetic radiation and controlling the level of A.C. power supplied to said lamp from said A.C. power supply lines, said control means being responsive to a control signal for varying the amount of power supplied to said lamp in dependence upon the value of said control signal;

feedback means for providing said control signal and including detection means for detecting the amount of power supplied to said lamp to provide an output signal, and means for comparing said output signal with a reference signal indicative of desired lamp output intensity and providing said control signal having a value in dependence upon any difference therebetween; and, said feedback means also including means for further varying said control signal so as to have a value dependent upon the speed of said printing press so that the intensity of radiation emitted by said lamp varies in dependence upon the speed of said printing press.

2. In a printing press as set forth in claim 1, including means for varying said reference signal for controlling the A.C. power supplied to said lamp in such a manner that the output intensity of said lamp is adjustable over a substantial portion of its range of output intensity without extinguishing.

3. In a printing press as set forth in claim 1 including means for electrically isolating said A.C. power control means from said feedback means.

4. In a printing press as set forth in claim 1 wherein said feedback means includes differential amplifier means responsive to both said output signal and to said reference signal for providing an amplified error signal having a value dependent upon, but greater than, the difference between the reference and output signals.

5. In a printing press as set forth in claim 4 wherein said means for supplying said control signal includes radiation source means connected to said comprising means and responsive to said error signal for providing a radiation signal as said control signal in accordance therewith, and radiation sensor means connected to said power supply control means responsive to said radiation signal to control the level of said A.C. power supplied by said power supply control means in accordance therewith.

6. In a printing press as set forth in claim 1 wherein said means for further varying said control signal includes a tachometer-generator for generating a speed signal dependent upon the speed of said printing press.

7. In a printing press as set forth in claim 1 further including blower means for cooling said arc discharge lamp, said blower means being coupled across said primary winding for cooling the arc discharge lamp at a rate directly proportional to the level of power supplied to said lamp.

* * * * *